US005516371A

United States Patent [19]

Kim et al.

[11] Patent Number: 5,516,371

[45] Date of Patent: May 14, 1996

[54] METHOD OF MANUFACTURING MAGNETS

[75] Inventors: Yoon-Bae Kim; Chang-Suk Kim, both of Daejeon; Tai-Seung Chung; Kil-Soo An, both of Seoul, all of Rep. of Korea

[73] Assignees: Korea Research Institute of Standard and Science; Mando Machinery Corp., Ltd., both of Rep. of Korea

[21] Appl. No.: 310,532

[22] Filed: Sep. 22, 1994

[51] Int. Cl.[6] ..... H01F 1/057

[52] U.S. Cl. ..... 148/104; 148/101

[58] Field of Search ..... 148/101, 104

[56] References Cited

U.S. PATENT DOCUMENTS 4,792,367 12/1988 Lee ..... 148/104

4,985,086 1/1991 Iwasaki et al. ..... 148/101

FOREIGN PATENT DOCUMENTS 0231630 8/1987 European Pat. Off. ..... 148/101

*Primary Examiner*—John Sheehan

*Attorney, Agent, or Firm*—Townsend and Townsend and Crew

[57] ABSTRACT

A RE-TM-B magnet is produced by employing a circular tube placed between a upper punch and a lower punch, wherein a magnetic powder is loaded. After the loading, the powder is hot pressed in the tube by the action of the upper punch at a temperature of 400° to 1000° C. to produce an isotropic magnet compact. Subsequently, the compact may be hot worked at a temperature of 400° to 1000° C. to obtain an anisotropic magnet, if desired.

13 Claims, 7 Drawing Sheets

METHOD OF MANUFACTURING MAGNETS

FIELD OF THE INVENTION

The present invention relates to a method of manufacturing a magnet by way of hot pressing a magnetic powder material in a tube to obtain a densified isotropic magnet and hot working the magnet to provide magnetic anisotropy thereto.

DESCRIPTION OF THE PRIOR ART

Generally speaking, there are two methods for manufacturing a RE-TM-B magnet which is composed of one or more rare earth(RE) elements, one or more transition metals(TM) and boron(B). One of the methods is to manufacture a magnet by, in a magnetic field, forming, sintering and heat treating a powder material which has been prepared by pulverizing an RE-TM-B magnet ingot, at a temperature higher than 1000° C., which is called the sintering method. Since this method requires that the powder material be treated at a high temperature, it is a rather expensive and complicated process and also the material can be easily oxidized.

The second method is to manufacture a magnet by way of: filling a die with a magnetic powder material of amorphous and/or fine crystal grains obtained by rapidly solidifying a molten alloy; pressing the powder to obtain a densified isotropic magnet compact; and hot working the compact, which is inserted in a die, at a temperature of about 700° C. to provide an anisotropic magnet, which is called the hot working method. It is simpler than the sintering method; and the possibility of oxidizing the workpiece is reduced. However, since a hot pressing die and/or a die upsetting die should be used at high pressure and temperature ranges repeatedly, such dies tend to be easily deformed or damaged. To minimize such deformation and damage problems, therefore, it has been proposed to use a die made of a material which has high stiffness and hardness. Since magnets come in various sizes and shapes, the task of making the dies with the hard material to meet the various size/shape requirements is a rather expensive and difficult proposition.

SUMMARY OF THE INVENTION

Accordingly, it is a primary object of the present invention to provide an economical method of manufacturing a magnet without having to use a die.

In accordance with one aspect of the present invention, there is provided a method of manufacturing a magnet containing one or more rare earth elements, one or more transition metals and boron by employing a pressing apparatus having at least one pressing member, which comprises the steps of:

(a) loading a magnetic powder material containing said one or more rare earth elements, one or more transition metals and boron into a tubular member; and (b) hot pressing the powder in the tubular member by the action of the pressing member at a temperature ranging from 400° to 1000° C. to densify the powder into the magnet.

BRIEF DESCRIPTION OF THE DRAWINGS

The above and other objects, and features of the present invention will become apparent from the following description given in conjunction with the accompanying drawings, wherein.

DETAILED DESCRIPTION OF THE PREFERRED EMBODIMENTS

Figure 1A:
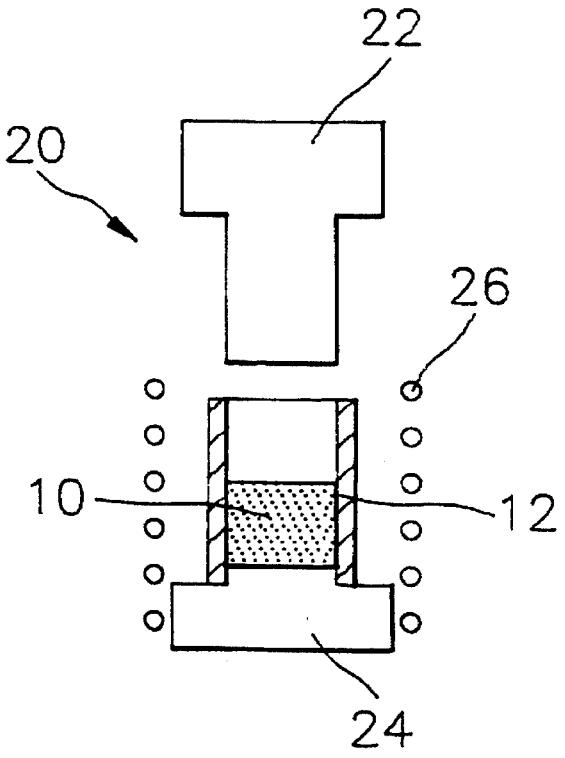
FIGS. 1A, 1B, 1C, 1D and 1E are schematic views of a preferred embodiment of the present invention, showing the hot pressing and die upsetting operations.
Figure 1B:
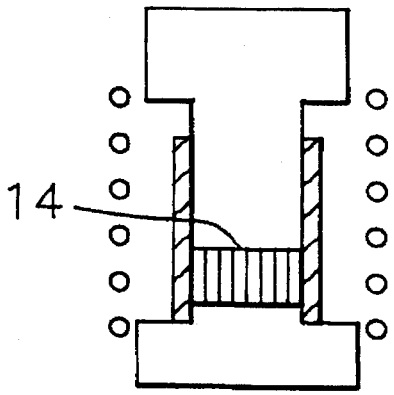

Referring now to FIGS. 1A and 1B, there is shown a preferred embodiment of the present invention. In accordance with the preferred embodiment, there is provided a process which comprises loading a magnetic powder material 10 into a tube 12, and hot pressing the powder 10 to obtain a densified isotropic magnet compact 14.

Figure 1C:
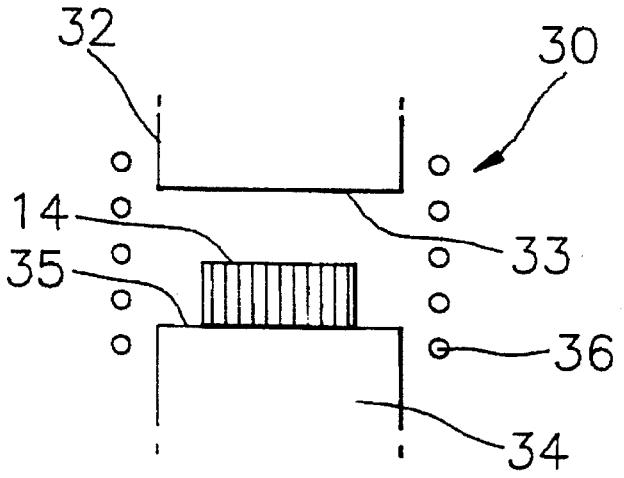
Figure 1D:
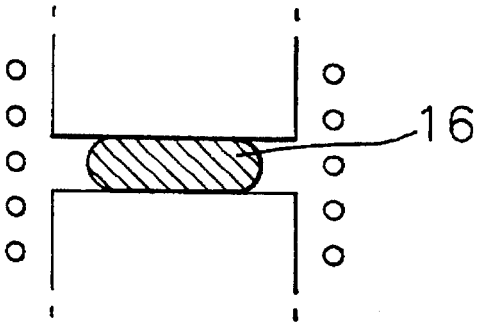
Figure 1E:
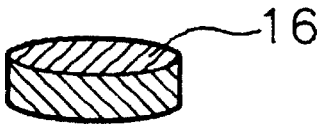

In the event an anisotropic permanent magnet 16 is desired, the compact 14 may be further hot worked, as illustrated in FIGS. 1C, 1D and 1E. The hot working operation is carried out by a die upsetting operation to provide magnetic anisotropy thereto.

The material which may be employed in the present invention includes one or more rare earth(RE) elements, one or more transition metals(TM) and boron(B). As the rare earth elements, Nd is generally used, although it may be partly or entirely replaced with Pr. In case of the transition metals, Fe is preferred, although it may be partly or entirely replaced with Co.

The powder 10 is produced by pulverizing a RE-TM-B magnet material obtained by rapidly solidifying the molten alloy thereof. The hollow tube 12 is configurated to produce the magnet 16 in its desired shape and size. The tube 12 preferably has a length longer than the height of the powder 10 loaded. The tube 12 is preferably made of a paramagnetic or non-magnetic metal, e.g., copper or stainless steel, or a ferromagnetic metal.

As shown in FIG. 1A, the hot pressing apparatus 20 has an upper punch 22, a lower punch 24 and a heater 26. The upper punch 22 may be structured to tightly fit into the tube 12; preferably, however, it is slightly spaced from the inner surface of the tube so that the upper punch 22 becomes capable of sliding in the tube 12. In the preferred embodiment, the shape of the upper punch 22 is shown to be circular. However, it should be understood that the shape of the upper punch 22 may be changed to correspond to the cross section of the tube 12. The upper punch 22 is attached to a pressing means(not shown). The lower punch 24 can also closely fit into the tube 12; but may be slightly spaced from its inner surface so that the tube 12 can be easily mounted on the lower punch 24. Similarly, the shape of the lower punch 24 may be adjusted to correspond to the cross section of the tube 12. The lower punch 24 is also attached to the pressing means. The heater 26 encloses the upper punch 22, the lower punch 24 and the tube 12.

FIG. 1C shows a die upsetting apparatus 30 having an upper punch 32, a lower punch 34 and a heater 36. The upper punch 32 has a flat punch face 33 which is large enough to cover a workpiece entirely. The upper punch 32 is attached to a pressing means(not shown). The lower punch 34 also has a flat punch face 35 which is sufficiently large to cover the workpiece entirely. The lower punch 34 is also attached to the pressing means. The heater 36 encloses the die upsetting apparatus 30.

Returning to FIG. 1A, the first step in the preferred embodiment is to load the magnetic powder material 10 into the tube 12. The upper punch 22 is raised to its uppermost position to facilitate the placement of the tube 12, as illustrated in FIG. 1A. The tube 12 is mounted on the lower punch 24. Subsequently, the powder 10 is poured into the tube 12 from a hopper(not shown).

After loading, the hot pressing operation commences. The upper punch 22 is lowered to exert a pressure, e.g., ranging from 0.1 to 0.5 ton/cm$^2$, on the powder 10 at a temperature ranging from 400° to 1000° C., and preferably from 700° to 800 ° C., so as to obtain a densified isotropic magnet compact 14, as illustrated in FIG. 1B. The pressure may be changed to correspond to the strength of the tube material and the thickness of the tube 12. The temperature is provided by the heater 26, e.g., resistance heater. A temperature lower than 400° C. may result in poor workability; and a temperature higher than 1000° C. may cause grain growth. After the compaction has been completed, the upper punch 22 is raised to its uppermost position. The tube 12 and the compact 14 are taken out; and the compact 14 is removed from the tube 12.

Following the hot pressing operation, as is shown in FIGS. 1C, 1D and 1E, the die upsetting operation takes place, if desired. The compact 14 is placed on the lower punch 34 of the die upsetting apparatus 30 by a suitable means, e.g., robot arm. Subsequently, the upper punch 32 is lowered to exert a pressure, e.g., of 2 ton/cm$^2$, on the compact 14 at a temperature ranging from 400° to 1000° C. and preferably from 700° to 800° C. The temperature is produced by the heater 36. During the compression process, the compact 14 is deformed plastically so that its height is reduced. The plastic deformation provides magnetic anisotropy thereto; and the anisotropic magnet 16 is obtained. The magnet 16 has the magnetization easy axis substantially parallel to the axis of compression direction. The magnet 16 may be crushed so as to obtain an anisotropic magnet powder.

Figure 2A:
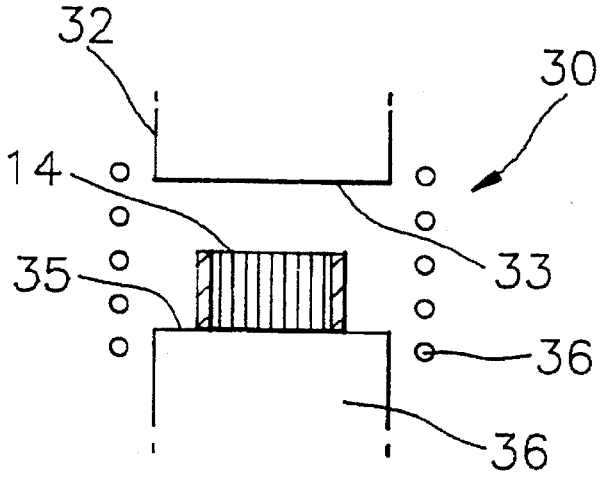
FIGS. 2A, 2B and 2C are schematic views of another preferred embodiment of the present invention, illustrating the die upsetting operation of an isotropic magnet compact enclosed in a tube.
Figure 2B:
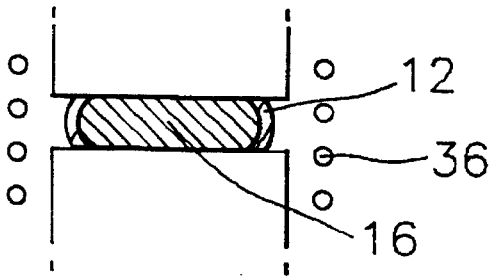
Figure 2C:
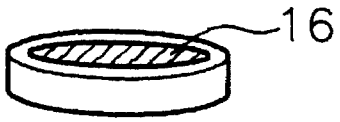

FIGS. 2A, 2B and 2C illustrate a second preferred embodiment of the invention with respect to the die upsetting operation. The die upsetting apparatus 30 illustrated in FIG. 2A has the same structure as the apparatus shown in FIG. 1C.

Specifically, after the hot pressing wherein the magnetic compact 14 has been obtained, the portion of the tube 12 which goes beyond the height of the compact 14 may be cut away by using a suitable means, e.g., saw. After the portion of the tube 12 has been removed, the die upsetting operation starts, as illustrated in FIG. 2A. The tube 12 and the compact 14 are hot worked together so as to obtain an anisotropic magnet 16 within the tube 12. The magnet 16 is preferably kept in the tube 12 for further processing, e.g., magnetization, if needed, so as to avoid any damage to the magnet.

Figure 3A:
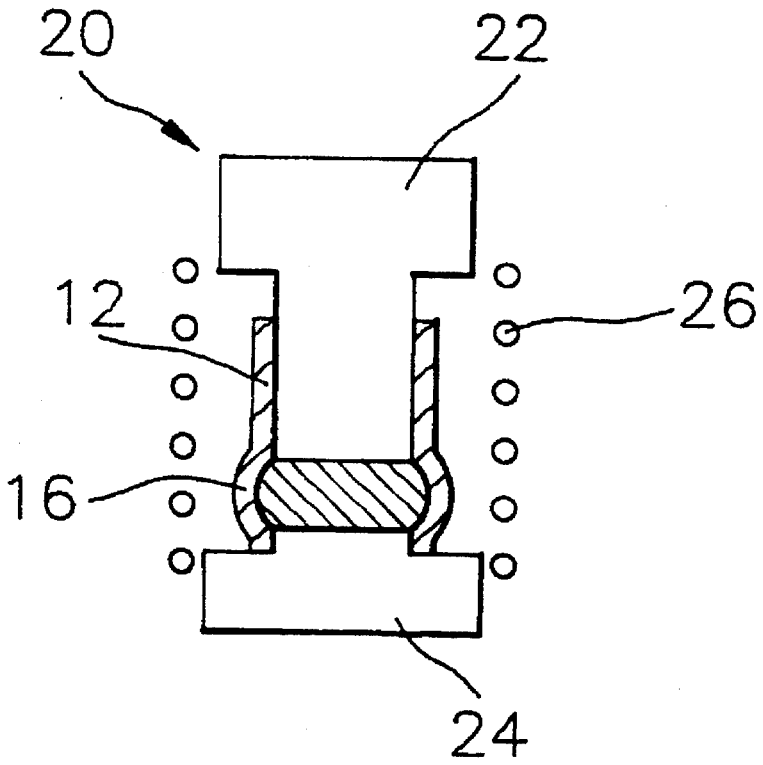
FIGS. 3A and 3B are schematic views of a third preferred embodiment of the present invention, depicting the die upsetting operation of the compact without removing the tube.
Figure 3B:
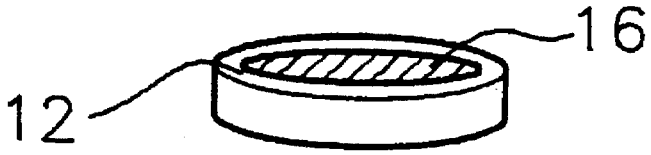
Figure 4A:
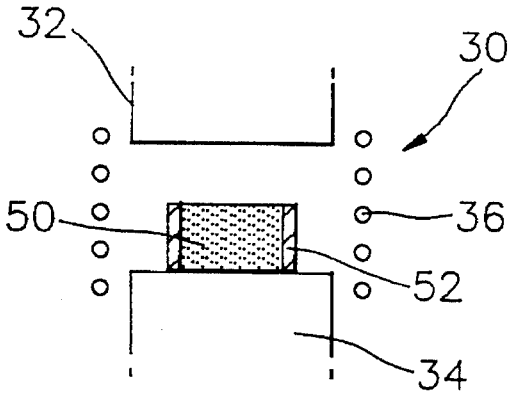
FIGS. 4A, 4B, 4C and 4D are schematic views of a fourth preferred embodiment of the present invention, explaining the process of hot pressing the powder filled in the tube and the die upsetting operation.
Figure 4B:
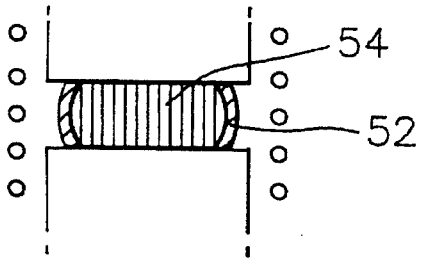
Figure 4C:
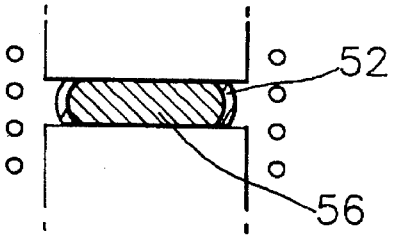
Figure 4D:
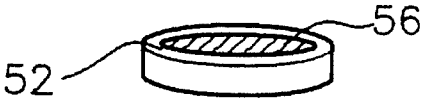

FIGS. 3A and 3B illustrate a third preferred embodiment. The die upsetting apparatus illustrated in FIG. 3A has the same structure as the apparatus shown in FIG. 1A. In this preferred embodiment, without removing any idle portion of the tube 12, the die upsetting operation is carried out.

As shown in FIGS. 4A, 4B, 4C and 4D, the hot pressing and die upsetting operations may be accomplished by only one stroke of the upper punch 32. At first, the punch 32 is lowered to press the powder 50 so that the powder 50 is densified into the isotropic magnet compact 54. Pressing continuously after the densification causes the compact 54 to deform plastically so that the anisotropic magnet 56 is obtained.

FIGS. 5A, 5B, 5C and 5D show a fifth preferred embodiment of the present invention. In accordance with the preferred embodiment, there is provided a process which comprises inserting in a tube 72 a compact 74 which has been made by a conventional method, and hot working the compact 74 to provide magnetic anisotropy thereto.

Figure 5A:
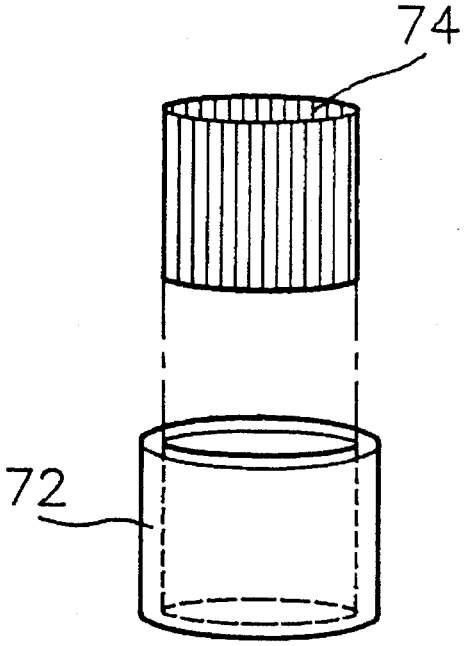
FIGS. 5A, 5B, 5C and 5D are schematic views of a fifth preferred embodiment of the present invention, representing the die upsetting operation with a compact made from a conventional method.
Figure 5B:
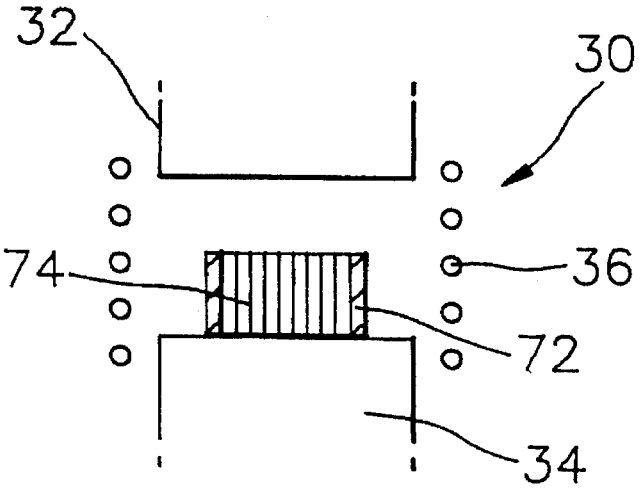
Figure 5C:
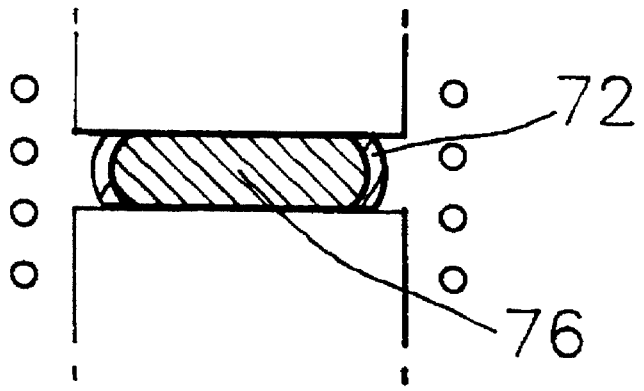
Figure 5D:
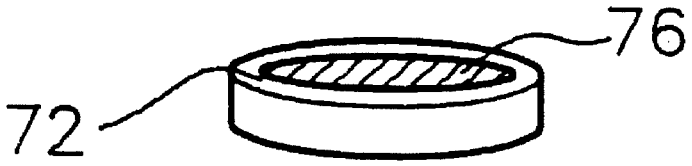

As shown in FIG. 5A, the compact 74, made by using a conventional method, is inserted into the tube 72 whose height is substantially equal to the height of the compact 74. After the inserting, the compact 74 enclosed in the tube 72 is placed on the lower punch 34, as illustrated in FIG. 5B. Thereafter, the upper punch 32 presses the compact 74 in the tube 72 to deform it plastically and obtain the anisotropic magnet 76.

As described above, the magnet is manufactured without having to use a hot pressing and/or a die upsetting die.

Although the invention has been shown and described with respect to the preferred embodiments, it will be understood by those skilled in the art that certain changes and modifications may be made without departing from the spirit and scope of the invention as defined in the following claims.

What is claimed is:

1. A method of manufacturing a magnet containing one or more rare earth elements, one or more transition metals and boron by employing a pressing apparatus having at least one pressing member, which comprises the steps of:

(a) loading a magnetic powder material containing said one or more rare earth elements, one or more transition metals and boron into a tubular member having a height, the magnetic powder material being loaded to a height that is the same as the height of the tubular member; and (b) hot pressing and hot working the magnetic powder material and the tubular member together by the action of one stroke of the pressing member at a temperature ranging from 400° to 1000° C. to densify the magnetic powder material into the magnet, said hot working providing magnetic anisotropy to the magnet.

2. The method of claim 1, wherein the tubular member is made of a metal.

3. A method of manufacturing a magnet containing one or more rare earth elements, one or more transition metals and boron by employing a first and a second pressing apparatus, and each pressing apparatus having at least one pressing member, which comprises the steps of:

(a) loading a magnetic powder material containing said one or more rare earth elements, one or more transition metals and boron into a tubular member;

(b) hot pressing the powder in the tubular member by the action of the pressing member in the first pressing apparatus at a temperature ranging from 400° to 1000° C. to densify the powder into a magnetic compact;

(c) removing the portion of the tubular member which goes beyond the height of the magnetic compact; and (d) hot working the magnetic compact and the tubular member together by the action of the pressing member in the second pressing apparatus at a temperature ranging from 400° to 1000° C. to provide magnetic anisotropy thereto.

4. The method of claim 3, wherein the tubular member is made of a metal.

5. A method of manufacturing an anisotropic magnet containing one or more rare earth elements, one or more transition metals and boron by employing a pressing apparatus having at least one pressing member, which comprises the steps of:

(a) inserting an isotropic magnet compact containing said one or more rare earth elements, one or more transition metals and boron into a tubular member; and (b) hot working the compact and the tubular member together by the action of the pressing member at a temperature ranging from 400° to 1000° C. to deform the compact plastically into the anisotropic magnet.

6. The method of claim 5, wherein the tubular member is made of a metal.

7. The method of claim 1, wherein said hot pressing step is performed at a temperature ranging from 700° to 800° C.

8. The method of claim 1, wherein said hot working step is performed at a temperature ranging from 700° to 800° C.

9. The method of claim 1, wherein said hot pressing step and said hot working step are performed at temperatures ranging from 700° to 800° C.

10. The method of claim 3, wherein said hot pressing step is performed at a temperature ranging from 700° to 800° C.

11. The method of claim 3, wherein said hot working step is performed at a temperature ranging from 700° to 800° C.

12. The method of claim 3, wherein said hot pressing step and said hot working step are performed at temperatures ranging from 700° to 800° C.

13. The method of claim 5, wherein said hot working step is performed at a temperature ranging from 700° to 800° C.

* * * * *